US005322278A

United States Patent [19]

Jeanrot

[11] Patent Number: 5,322,278

[45] Date of Patent: Jun. 21, 1994

[54] RACKET COMPRISING AN INJECTED HANDLE AND PROCESS FOR PRODUCING SAME

[76] Inventor: Patrick Jeanrot, 51, Avenue Lucien Barrault, 94500 Champigny-sur-Marne, France

[21] Appl. No.: 646,628

[22] PCT Filed: Dec. 27, 1990

[86] PCT No.: PCT/FR90/00946

§ 371 Date: Jan. 31, 1991

§ 102(e) Date: Jan. 31, 1991

[87] PCT Pub. No.: WO91/09652

PCT Pub. Date: Jul. 11, 1991

[30] Foreign Application Priority Data

Jan. 2, 1990 [FR] France ..... 90 00012

[51] Int. Cl.[5] ..... A63B 49/02; A63B 49/10

[52] U.S. Cl. ..... 273/73 G; 273/73 R; 273/73 J

[58] Field of Search ..... 273/73 R, 73 C, 73 G, 273/73 J, DIG. 23

[56] References Cited

U.S. PATENT DOCUMENTS

| | | | |
|---|---|---|---|
| 4,007,929 | 2/1977 | Figa | 273/73 G X |
| 4,340,226 | 7/1982 | Haines | 273/73 F |
| 4,725,059 | 2/1988 | Du Gardin et al. | 273/73 F X |
| 4,746,119 | 5/1988 | Jeanrot | 273/73 G X |
| 4,915,382 | 4/1990 | Madsen | 273/73 G |
| 5,071,125 | 12/1991 | Shen | 273/73 R |
| 5,108,114 | 4/1992 | Marx | 273/73 G |

FOREIGN PATENT DOCUMENTS

| | | | |
|---|---|---|---|
| 2617405 | 1/1989 | France | 273/73 R |
| 2620627 | 3/1989 | France | 273/73 R |

*Primary Examiner*—Vincent Millin
*Assistant Examiner*—Raleigh W. Chiu
*Attorney, Agent, or Firm*—Mark T. Basseches

[57] ABSTRACT

This invention relates to a racket for ball games, comprising a separable handle 22 and head frame 14, the head frame 14 being made by moulding a plastics material and the handle 22 by injecting a plastics material, the racket comprising an articulation 32 enabling the handle 22 to be folded along the head frame 14 and elements 50, 48, 52, 44, 46 allowing rigid assembly of the handle 22 in the extension of the head frame 14.

4 Claims, 5 Drawing Sheets

RACKET COMPRISING AN INJECTED HANDLE AND PROCESS FOR PRODUCING SAME

The invention principally relates to a racket for a ball game, particularly for tennis, and to its process of production.

It is well known to produce tennis rackets by moulding. Such rackets present a sufficient rigidity to enable the ball to be returned correctly. These rackets do not have a sufficient flexibility to give an impression of comfort to the player. Moreover, the vibrations are only weakly absorbed before being transmitted to the player's arm. This results in a disorder often called "tennis elbow".

The firm DUNLOP has marketed tennis rackets made by injection. Such rackets offer a more comfortable game due to their flexibility, but do not allow precise control of the balls due to lack of rigidity. Moreover, such rackets still transmit a considerable part of the vibrations to the player's arm.

French Patent No. 85 01018 published under No. 2 579 898, its Certificate of Addition No. 85 08117 published under No. 2 582 527, as well as French Patent No. 87 09398 published under No. 2 617 405, describe folding rackets composed of two parts: a handle and a head frame. This document suggests the use, between the handle and the head frame, at least at certain spots, of vibration-absorbing bearings.

The starting point of the present invention is the observation that the mechanical behaviour demanded of the head frame to send the ball with force and precision is not the same as that demanded of the handle for ensuring the player's comfort.

According to the invention, a handle is made by a process of injection. In this way, a handle is obtained which will give a supple racket pleasant to play with. Moreover, this injection technique is of low cost price and does not require any finishing.

A frame made by injection would not give satisfaction from the standpoint of performance. The head frame must thus be produced for example by moulding.

Means for the absorption or non-transmission of vibrations are advantageously interposed between the frame and the handle. The systematic interposition at all places of direct contact or via other parts, for example the parts for rigidly fixing the handle in the extension of the frame, of vibration-absorbing means, contributes to the impression of comfort that the player feels. Moreover, this is much healthier and avoids tennis accidents.

It is a principal object of the invention to produce a racket for ball games, comprising a handle and a head frame, the head frame being made by moulding a plastics material and the handle being made by injection of a plastics material.

The invention also has for its object a racket, characterized in that it is a tennis racket.

The invention also relates to a racket, characterized in that it comprises an articulation enabling the handle to be folded along the head frame and means for rigidly assembling the handle in the extension of the head frame.

The invention also relates to a racket, characterized in that the rigid assembly means comprises a screw dependent on the handle driven by a knurl and cooperating with a nut mounted in the base of the frame and that it further comprises vibration-absorbing means interposed between the screw and the handle so as to avoid an-y direct contact between the screw and the handle.

The invention also relates to a racket, characterized in that the nut is made in the form of a metal insert comprising a shoulder and placed in an opening made at the base of the frame.

The invention also relates to a racket, characterized in that that part of the handle opposite the frame is covered with two half-shells coated with a material rendering hand grip optimal.

The invention also relates to a racket, characterized in that it comprises a knob placed at the end of the handle opposite the frame, maintained in place by two parts passing in openings made in the knob and in openings made in the handle, the two parts for holding the knob being assembled by clipping.

The invention also relates to a racket, characterized in that the articulation is in omega form and it can be separated into two parts.

The invention also relates to a racket, characterized in that it comprises strings and means for fixing the strings embedded in the frame.

The invention also relates to a racket, characterized in that the frame comprises two lateral arms extending towards each other and said lateral arms are extended at their ends by vibration-absorbing means.

The invention also relates to a process for producing a racket or part of a racket for ball games, characterized in that it comprises the steps of:

making a handle by injection of plastics material;

making a frame by moulding plastics material.

The invention also relates to a process, characterized in that, when making the handle, injection of plastics material is effected around short fibers.

The invention also relates to a process for making a racket for ball games, characterized in that it comprises the steps of:

making parts from a vibration-absorbing material;

assembling the handle and the frame with the interposition, at all the points of direct contact, or through other parts, of parts made of a vibration-absorbing material.

The invention will be more readily understood from the following description and accompanying Figures given as non-limiting examples, in which:

In FIGS. 1 to 5, the same references have been used to designate the same elements.

Figure 1:
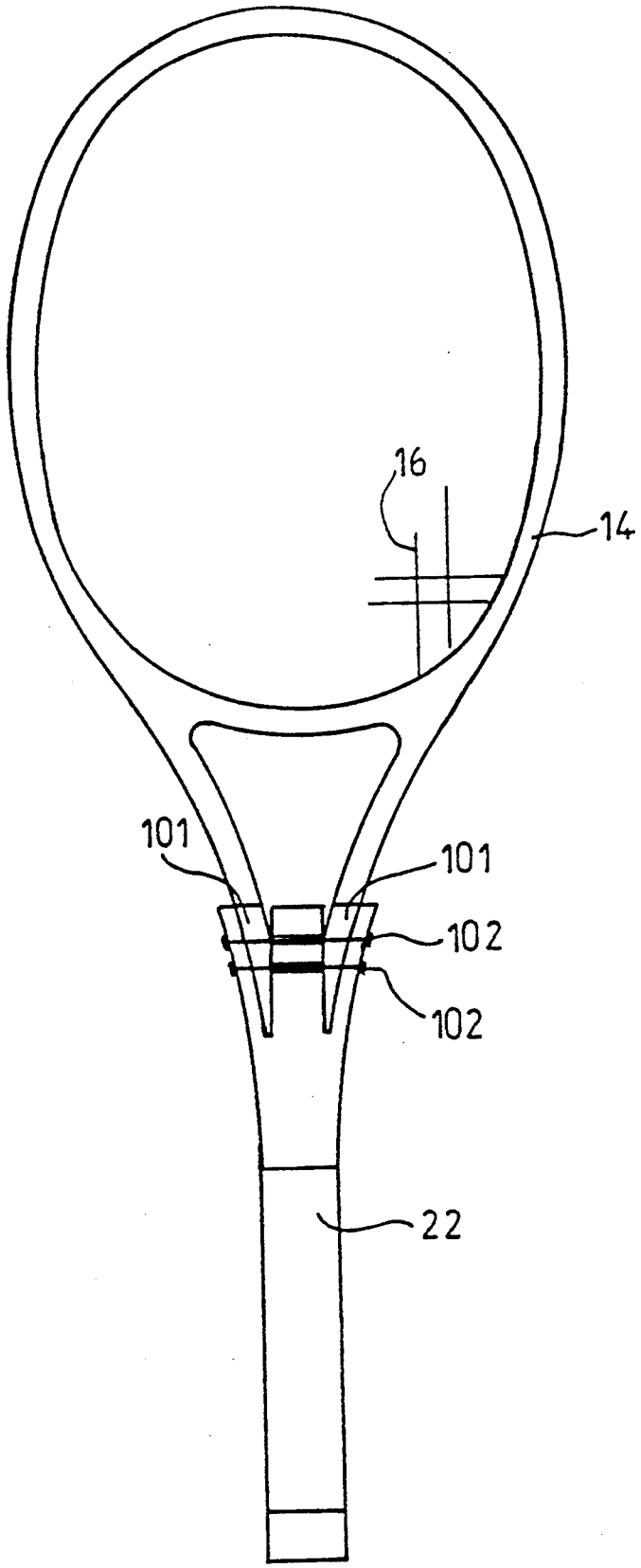
FIG. 1 is a front view of a rigid racket according to the present invention.

FIG. 1 shows a racket according to the present invention, comprising a frame 14 and a handle 22. The frame 14 is intended to support taut strings 16. An elastic contact between the ball and the strings 16 makes it possible to direct said ball in a desired direction and speed. Moreover, it is possible to induce in the ball a movement of rotation which will render the opponent's game more difficult. The racket according to the present invention comprises a frame 14 optimalized to obtain the best possible control of the ball. Such optimalization is rendered possible in particular in that it will have no detrimental consequences on the comfort of the game.

The frame 14 is advantageously as rigid as possible.

Advantageously, it is made by moulding a plastic resin around a core made of long fibers. Glass, carbon fibers are for example used, or fibers sold under the Trademark KEVLAR by the firm DUPONT DE NEMOURS. It may prove useful to surround the fibers of the core with foam. The fibers are surrounded for example by an epoxy resin. In the example illustrated in FIG. 1, the Frame 14 is permanently fixed on a handle 22. Permanent fixing is for example ensured by two rivets 102 passing through the handle and extensions 101 of the head frame. However, it is obvious that an embodiment in which the frame 14 may be separated from the handle 22 either by the final user or in the workshop, does not depart from the scope of the present invention.

The handle 22 is optimalized in order to procure comfort of the game for the sportsmen.

The flexibility of the handle 22 is advantageously greater than that of the frame 14.

The handle 22 is advantageously made by injection of a plastics material in a mould.

Injection is advantageously effected around a core made of short fibers. Short fibers are understood to mean fibers of which the length is less than 4 cm, typically between 1 and 2 cm.

A process of injection-blow moulding is advantageously employed.

Figure 2:
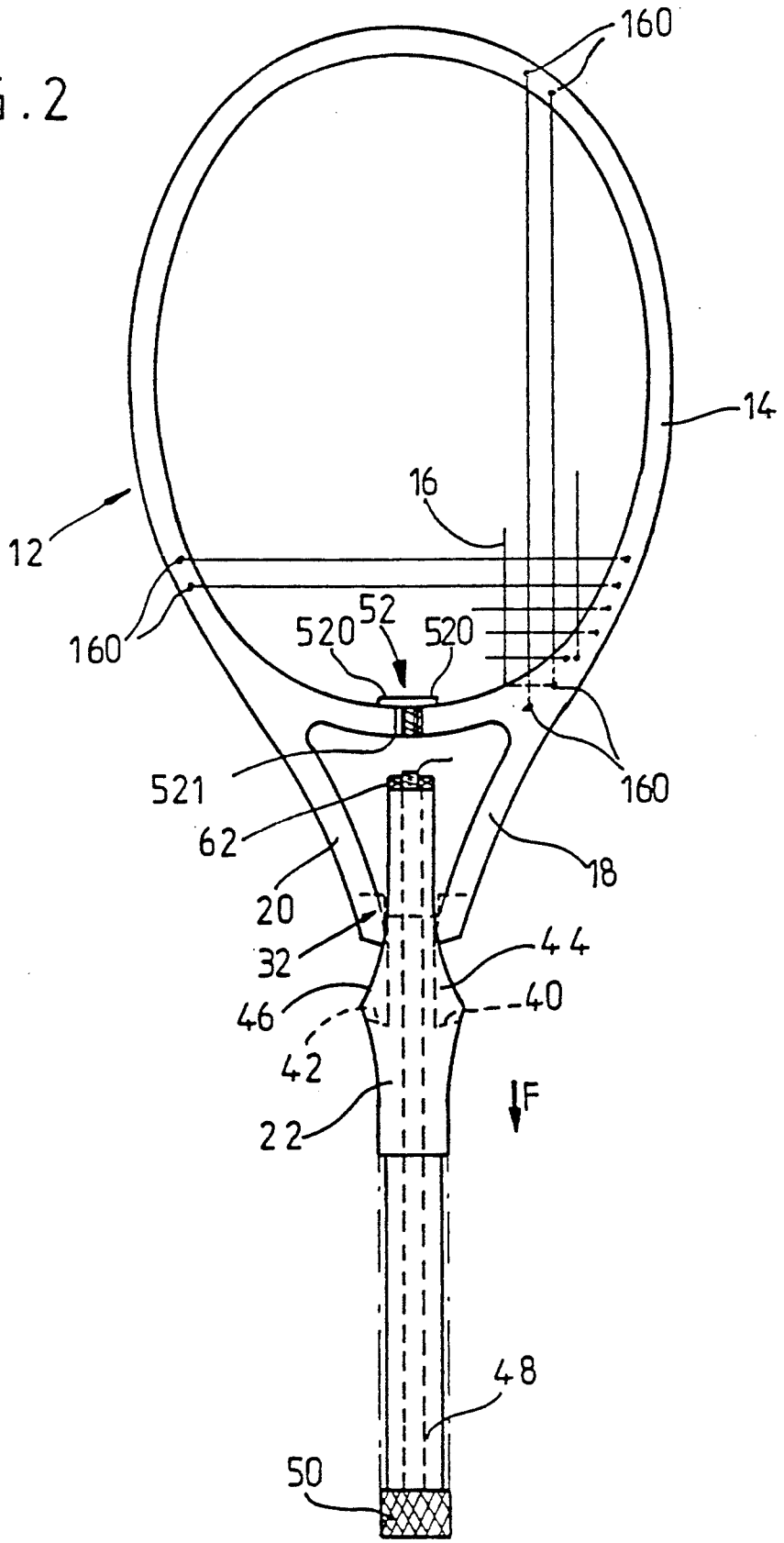
FIG. 2 is a front view of a first embodiment of a folding racket according to the present invention.
Figure 3:
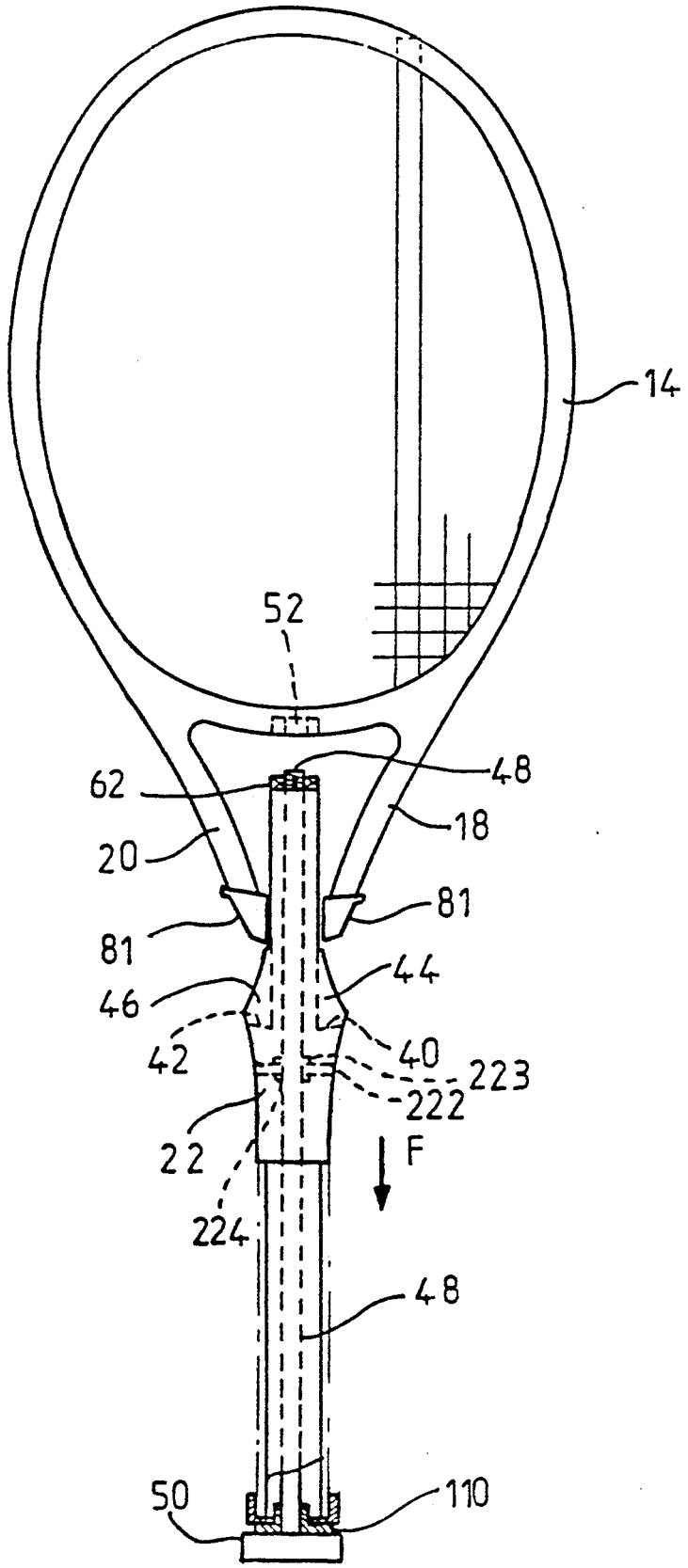
FIG. 3 is a front view of a second embodiment of a folding racket according to the present invention.

FIGS. 2 and 3 show embodiments of rackets according to the present invention incorporating improvements. The various improvements made to the rackets of FIGS. 1, 2 or 3 may be combined so as to constitute the desired racket.

The racket illustrated in FIG. 2 comprises a head 12 formed by a frame 14 of substantially oval shape on which is stretched a stringing 16. In the example illustrated in FIG. 2, the stringing 16 is fixed to anchoring means 160, for example studs embedded in the frame 14. In a first embodiment, as illustrated in FIG. 2, the stringing 16 is composed of a plurality of independent strings. Each string comprises anchoring means 160 at its ends. In a second embodiment (not illustrated) of conventional stringing, the successive strings are constituted by a stringing guided and maintained taut by guiding means. The guiding means are embedded in a frame 14. The ends of the stringings are secured by anchoring means 160.

In a third variant embodiment of the device according to the present invention, the stringing 16 is a monobloc part, the strings being assembled at the level of their intersection. Such a stringing 16 is made for example of Nylon or a metal alloy, for example an alloy containing aluminium. In such a case, the stringing 16 is stretched either by anchoring means 160, or by guiding means around which it is wound.

The embodiment of a frame 14 in which the stringing 16 is permanently fixed no longer allows the stringing to be changed.

However, this drawback is compensated by the fact that, on the one hand, the production cost of the frame is reduced, as it no longer necessitates openings to allow the stringing to pass and, on the other hand, in that, if it proved necessary to change the stringing, it will no longer be necessary to change the whole racket, but solely the frame 14. Moreover, the stringing produced industrially in the factory will be cheaper than that made by a craftsman in a sports shop. Moreover, contrarily to the rackets of known types, a change in stringing which, in the case of the present invention, comes to changing the frame 14, does not automatically render the preceding stringing unusable. Moreover, it is possible to have several types of stringings in order to adapt to several types of games, or to several styles of games of several different people or to buy a stringing, with its associated frame, improved, for example by the technical progress made since the purchase of the racket.

The frame 14 comprises two lateral arms 18 and 20 which extend towards the handle 22. The intermediate part of the handle 22 located at the level whore arms 18, 20 join, comprises an articulation 32 with offset axes, constituted by an omega-shaped pivot pin presenting a central pivot section transversely traversing the handle and two outer pivot sections parallel to the central section and transversely traversing the arm of the frame, with the result that the central section and the outer sections define offset pivot pins enabling the handle to be folded flat aqainst the head.

The pivot pin 32 comprises an intermediate section between the central section and the outer section substantially perpendicular to the central section and to the outer section.

The handle 22 advantageously comprises an elongated slot in the longitudinal direction of the handle so that the central section of the pivot pin 32 may be displaced longitudinally with a limited clearance. The handle 22 also comprises lateral housings 40, 42 adapted to receive the ends of the lateral arms 18, 20 of the frame 14 as well as the intermediate sections of the pivot pin 32, consequently enabling these intermediate sections and, if necessary, the ends of the arm of the frame, to be concealed.

In an embodiment illustrated in FIGS. 2 and 3, the dismountable fixing device between the handle 22 and the frames 14 consists in a screw 48 dependent of the handle 22 and driven by a knurl 50 and cooperating with a nut 52 mounted in the form of an insert in the base of the frame 14. The screw 48 advantageously traverses the handle 22 over its whole length, the driving knurl 50 being located at the end of the handle 22 opposite the frame 14.

The nut 52 is advantageously metallic, for example stainless steel.

The nut 52 advantageously comprises, a shoulder 520 and shank 521 extending through the frame. The base of the frame 14 comprises an opening in which the nut 52 is placed. This arrangement facilitates the exchange of the nut 52, in the workshop, or by the user, if use under particularly difficult conditions has distorted the screw pitch. Such a case may occur for example during a match on clay, when sand has penetrated inside the screw pitch and, despite the presence of this sand, the knurl 50 has been forced.

The handle 22 is advantageously insulated from the vibrations which may be transmitted thereto by the frames 14, directly or via the screw 48. As illustrated in FIG. 2, the end of the screw 48 intended to penetrate in the nut 52 is insulated from the handle 22 by vibration-absorbing means 62.

To be able to play, the frame 14 is connected with the handle 22 by causing the ends of the arms 18 and 20, advantageously provided with vibration-absorbing means, to penetrate in the recesses 42. Suitable vibration absorbers are well known, representative examples being rubber and polyurethane foam. These recesses are flanked by rigid wall means 44 and 46 which improve the solidity of the assembly. Screw 48 driven by knurl 50 is screwed in nut 52.

When the dismountable fixing device is released, the handle 22 is firstly moved away longitudinally with respect to the frame (arrow F), this being rendered possible by the fact that the central section of the pivot pin 32 is received in the elongated slot in the longitudinal direction of the handle.

It is noted that the lateral arms 18, 20 of the frame 14 are then disengaged from their housing 40, 42, 20 and the intermediate sections of the pivot pin 32 are disengaged with respect to the means 44 and 46, which therefore allows rotation of the pivot 32 and folding of the handle 22 against the head 12. In the embodiment illustrated in FIG. 3, the vibration-absorbing means 81 located at the ends of the arms 18 and 20 of the frame 14 follow the shape of these ends. The means 81 hold by force on the ends of the arms 18 and 20. Moreover, the knurl 50 is surrounded by vibration-absorbing means 110 constituted for example by a bush. In the case illustrated in FIG. 3, all the vibrations coming from the frame 14 are filtered and absorbed by vibration-absorbing means 62, 81 and 110 before any possibility of transmission towards the handle 22. The possibility of choosing three different materials, one for the frame, one for the handle and one for the vibration-absorbing means, allows a perfect adaptation of these materials for the function that they have to exert with respect to one another, in order to optimalize the efficiency of the game and the comfort of the player.

The screw 48 is advantageously centred in the handle 22 by a ring 222. The ring 222 comprises for example a washer made of rubber or polyurethane foam. It improves the resistance of the screw 48 and participates in the absorption of the vibrations coming from the frame 14.

The ring 222 is advantageously surrounded by two washers 223 and 224 fast with the screw 48. In this way, a rotation of the knurl 50 will take along washers 223 and 224 via screw 48. These washers will provoke an abutment of the ring 222 on the inner wall of the handle 22. In this way, the ring 222 participates in the connection of the handle 22 and of the frame 14. The ring 222 is disposed at the place where it participates best in the balance of the racket according to the present invention.

The embodiment of the rackets particularly as illustrated in FIGS. 2 and 3 not comprising articulations, does not depart from the scope of the invention. In such a case, the racket no longer comprises a slot nor pivot pins. However, it remains dismountable into two parts, the handle 22 being separable from the frame 14.

FIG. 4 shows an omega-shaped articulation 32 according to the present invention. As described previously, the articulation 32 with offset axes presents a central pivot section 321, two pivot sections 322 parallel to the central section 321 and intermediate sections 323, substantially perpendicular to the central section 321 and to the outer section 322 that it connects.

Figure 4A:
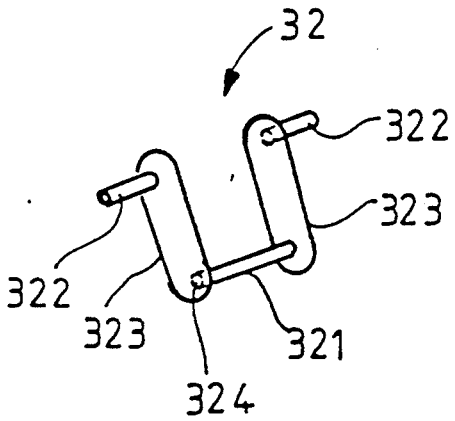
FIG. 4 is a view in perspective of an element advantageously employed in a racket according to the present invention.
Figure 4B:
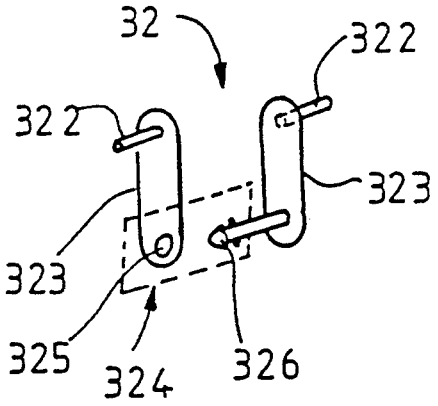

The articulation 32 advantageously comprises a means 324 for mounting and dismounting the articulation 32 in two parts. The assembled articulation 32 is illustrated in FIG. 4*a*, the dismounted articulation 32 is illustrated in FIG. 4*b*. In the example illustrated in FIG. 4, the mounting and dismounting means 324 are located at one of the ends of the central section 321.

In the example illustrated in FIG. 4, the mounting and dismounting means 324 comprise a groove 325, for example made in the intermediate part 323 and a lip 326 for example placed near an end of the central section 321. Mounting of the two parts of the articulation 32 is effected by passing lip 326 in groove 325 or by exerting a sufficient force to provoke clipping.

On the one hand, the possibility of dismounting the articulation 32 facilitates separation of the frame 14 and handle 22. This adaptation is rendered necessary, in order to ad..apt a handle to a desired frame, either by a deterioration of one of the parts, or finally to adapt to a style or a phase of the game of a player.

On the other hand, insofar as the strap 34 made in the handle 22 is not centred as in the case of an embodiment illustrated in FIGS. 2 and 3, the racket according to the present invention can only be folded on one side. In such a case, an attempt to fold the racket in the wrong direction will provoke separation of the articulation 32 into two. No damage will result therefrom; this articulation may be remounted without problem.

Figure 5:
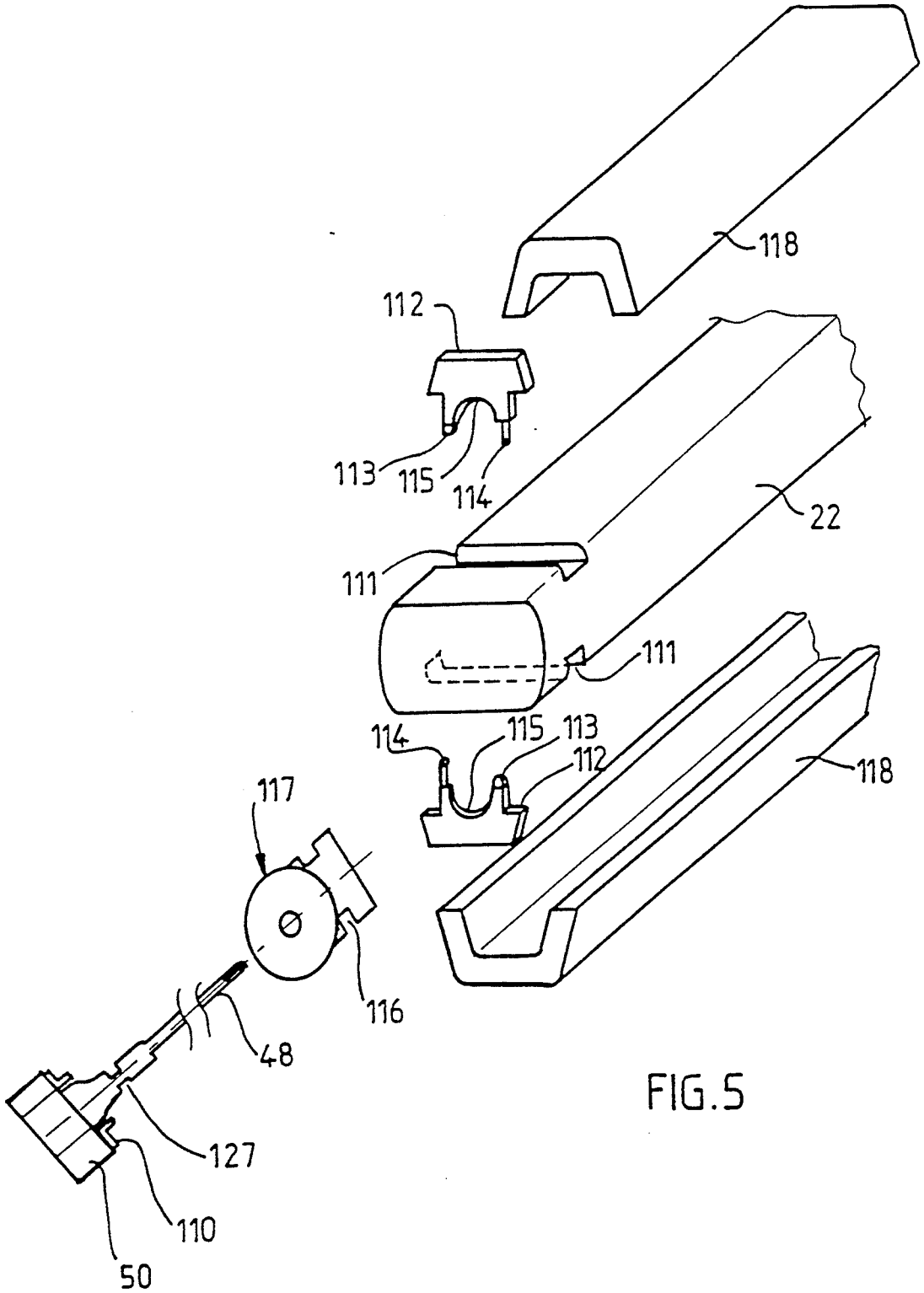
FIG. 5 is a view in perspective of the parts advantageously employed for making a racket according to the present invention.

FIG. 5 shows an embodiment of the end of the handle 22 opposite the frame 14.

Handle 22 comprises a shell 118. Shell 118 is adapted to be covered by a coating or grip advantageously made of leather, intended to facilitate the handgrip of the racket. Shell 118 is advantageously composed of two half-shells, as illustrated in FIG. 5. Production of the shell 118 as well as assembly thereof on the end of the handle 22 is thus facilitated.

The end of the handle 22 comprises means 117 for guiding the screw 48. In the example illustrated in FIG. 5, the guiding means 117 are in the form of a knob adapted to be positioned in the end of the handle 22. The knob 117 advantageously comprises cut-outs 116 intended to come opposite the cut-outs 111 made in the end of the handle 22. Tenons 112 are adapted to traverse the cut-outs 111 and 116, to ensure connection of the handle 22 and the knob 117. In the example illustrated in FIG. 2, the tenons 112 present a circular cut-out 115 making it possible to surround a groove 127 made in the extension of the knurl 50 surrounding the screw 48.

Two tenons 112 are advantageously used for assembling the knob 117 and the handle 22. The tenons 112 advantageously comprise means allowing mechanical assembly thereof. In the example illustrated in FIG. 5, each tenon 112 comprises male means 114 and female means 113 placed opposite, allowing their mechanical assembly.

The vibration-absorbing means 110 is advantageously placed between the knurl 50 and the knob 117.

The knob 117 or the knurl 50 is advantageously provided with a hook (not shown in FIG. 5) allowing hooking, when the handle 22 is in folded position, on the frame 14 or on the stringing 16.

The invention is particularly applicable to the production of rackets for ball games, presenting improved performances and comfortable game. In the rackets of known types, these two criteria were contradictory.

The invention is principally applicable to the production of tennis rackets whose frame is highly rigid in order to allow a high-performance gamer and whose handle is highly flexible in order to allow a comfortable game, vibration-absorbing means ensuring adaptation of the frame and handle.

I claim:

1. A multi-part tennis racket comprising in combination a head frame having a base and a handle having a butt end and an attachment end, said head from being structurally rigid and comprised of plastic material molded other than by an injection molding procedure, said handle being relatively flexible and fabricated by injection-blow molding and being comprised of plastic molded about fibers, articulation means interposed between said frame and handle for foldably linking said frame and handle, lock means for locking said frame and handle in coplanar alignment, said lock means comprising a male threaded member rotatably mounted in said handle and including a knurl exposed at said butt end of said handle, and a free end extending axially beyond said attachment end of said handle and a metallic nut mounted in said base of said frame and positioned to receive said free end of said threaded member, said nut including a shoulder, vibration absorbing means interposed between said shoulder of said nut and said frame and between said knurl and said handle for isolating said nut and knurl from direct contact with said handle to thereby dampen vibrations transmitted from said frame to said handle.

2. A racket in accordance with claim 1 wherein said fibers of said handle are of a size range of from about 1 to 2 centimeters.

3. The process of producing a tennis racket comprising the steps of molding, by a process other than injection molding, a rigid string supporting plastic head frame, molding by injection-blow molding a plastic handle adapted to be connected to said head frame, said handle including fibers to thereby render said handle shock absorbing, interposing vibration dampening material between said head frame and said handle whereby no direct frame to handle contact is present, and removably connecting said head to said handle.

4. The process of claim 3 wherein said fibers are of a size range of from about 1 to 2 centimeters.

* * * * *